US009628900B2

(12) United States Patent
Yang et al.

(10) Patent No.: US 9,628,900 B2
(45) Date of Patent: Apr. 18, 2017

(54) DOUBLE-VIBRATING-DIAPHRAGM LOUDSPEAKER MODULE

(71) Applicant: GOERTEK INC., WeiFang (CN)

(72) Inventors: Jianbin Yang, WeiFang (CN); Chao Jiang, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/892,121

(22) PCT Filed: Dec. 13, 2013

(86) PCT No.: PCT/CN2013/089392

§ 371 (c)(1),
(2) Date: Nov. 18, 2015

(87) PCT Pub. No.: WO2014/187115

PCT Pub. Date: Nov. 27, 2014

(65) Prior Publication Data

US 2016/0119718 A1 Apr. 28, 2016

(30) Foreign Application Priority Data

May 18, 2013 (CN) ..... 2013 1 0187433

(51) Int. Cl.
*H04R 1/24* (2006.01)
*H04R 9/02* (2006.01)
(Continued)

(52) U.S. Cl.
CPC ..... *H04R 1/24* (2013.01); *H04R 1/28* (2013.01); *H04R 1/2807* (2013.01); *H04R 7/18* (2013.01);
(Continued)

(58) Field of Classification Search
CPC ..... H04R 2400/07; H04R 2400/03; H04R 9/043; H04R 9/063; H04R 2209/026; H04R 7/18; H04R 9/02; H04R 9/06
See application file for complete search history.

(56) References Cited

U.S. PATENT DOCUMENTS 7,936,251 B1 * 5/2011 Hamaguchi ..... B06B 1/0284 340/7.1
2001/0033215 A1 * 10/2001 Sakai ..... B06B 1/045 335/252
(Continued)

FOREIGN PATENT DOCUMENTS

CN 201328185 Y 10/2009
CN 103209377 A 7/2013
(Continued)

OTHER PUBLICATIONS

International Search Report for PCT/CN2013/089392 filed on Dec. 13, 2013.
(Continued)

*Primary Examiner* — Matthew Eason

(57) ABSTRACT

A double-diaphragm loudspeaker module comprises: a housing providing with a first sound hole and a second sound hole; a supporting structure fixed on an inner wall of the housing; and a loudspeaker unit comprising a first diaphragm, a sound coil, a magnetic circuit system and a second diaphragm. The sound coil and the magnetic circuit system are separately combined with the first diaphragm and the second diaphragm. The housing, the supporting structure and the loudspeaker unit form a first front sound cavity, a second front sound cavity, and a rear sound cavity. The first front sound cavity comprises a space between the first diaphragm and the housing. The second front sound cavity comprises a space between the second diaphragm and the
(Continued)

housing. The rear sound cavity comprises a space between the first diaphragm and the second diaphragm.

11 Claims, 5 Drawing Sheets

(51) Int. Cl.
*H04R 9/06* (2006.01)
*H04R 1/28* (2006.01)
*H04R 7/18* (2006.01)
*H04R 1/02* (2006.01)

(52) U.S. Cl.
CPC ..... *H04R 9/02* (2013.01); *H04R 9/06* (2013.01); *H04R 9/063* (2013.01); *H04R 1/02* (2013.01); *H04R 1/025* (2013.01); *H04R 2400/07* (2013.01)

(56) References Cited

U.S. PATENT DOCUMENTS

2011/0243367 A1* 10/2011 Lee ..... H04R 9/066 381/398
2011/0249858 A1* 10/2011 Lee ..... H04R 9/066 381/398
2011/0255732 A1* 10/2011 Kwon ..... H04R 9/06 381/396
2014/0009008 A1* 1/2014 Li ..... B06B 1/045 310/28
2014/0185837 A1* 7/2014 Kunimoto ..... H04R 1/1075 381/151
2014/0185839 A1* 7/2014 Hashimoto ..... H04R 9/025 381/162

FOREIGN PATENT DOCUMENTS

CN 103297904 A 9/2013
CN 203193868 U 9/2013
CN 203301728 U 11/2013
JP 2008-99106 A 4/2008

OTHER PUBLICATIONS

Office Action from Korean Patent Office for Application No. 10-2015-7035755, dated Sep. 19, 2016.

* cited by examiner

DOUBLE-VIBRATING-DIAPHRAGM LOUDSPEAKER MODULE

CROSS-REFERENCE OF RELATED APPLICATION

The present invention is a U.S. National Stage of PCT/CN2013/089392, filed Dec. 13, 2013, which claims the priority of Chinese patent application No. 201310187433.8 filed on May 18, 2013, which are incorporated herein by reference.

TECHNICAL FIELD

The present invention relates to the technical field of loudspeaker, more specifically, to a double-vibrating-diaphragm loudspeaker module.

BACKGROUND

Currently, loudspeakers with vibration function are widely used, and such loudspeakers have the functions of normal loudspeakers as well as vibrating motors. In an existing loudspeakers, generally, a magnetic circuit system used as a vibrator is not fixed on the housing of the loudspeaker, but supported and fixed by an elastic support, so as to enable the loudspeaker to generate vibration while the magnetic circuit system is vibrating. Under low frequency, the magnetic circuit system with lower resonant frequency can generate obvious vibration, while the loudspeaker in which the voice coil is used as a vibrator does not generate obvious vibration. In this case, the loudspeaker can be used as a vibrating motor. However, under intermediate or high frequency, the magnetic circuit system with lower resonant frequency does not vibrate obviously, while the vibration system vibrates obviously. In this case, the loudspeaker can be used as an electro-acoustic transducer, i.e., an usual loudspeaker. In the existing loudspeaker with vibration function, the elastic supports used for supporting the magnetic circuit system are mainly metal elastic structures which only support and fix the magnetic circuit system, but it cannot improve the low frequency acoustic characteristic of the loudspeaker.

SUMMARY

The present invention is intended to solve the above problems existed in the prior art, and provides a double-vibrating-diaphragm loudspeaker module which comprises a double-vibrating-diaphragm loudspeaker unit, in which a magnetic circuit system is supported by a vibration diaphragm instead of an elastic support, so as to improve the low frequency acoustic characteristic of the whole loudspeaker module.

In order to achieve the above objectives, the present invention provides a double-vibrating-diaphragm loudspeaker module comprising: a peripheral housing provided with a first sound hole and a second sound hole; a supporting member fixed on an inner surface of the peripheral housing; and a loudspeaker unit comprising a first vibrating diaphragm, a voice coil, a magnetic circuit system and a second vibrating diaphragm. Wherein, the voice coil is combined with the first vibrating diaphragm, and the magnetic circuit system is combined with the second vibrating diaphragm. The voice coil is accommodated in a magnetic gap of the magnetic circuit system, and edges of the first vibrating diaphragm and the second vibrating diaphragm are fixed on the supporting member. Wherein, the peripheral housing, the supporting member and the loudspeaker unit form a first front acoustic cavity, a second front acoustic cavity, and a rear acoustic cavity. The first front acoustic cavity comprises a space between the first vibrating diaphragm and a part of the peripheral housing closing to the first vibrating diaphragm, and communicates with outside via the first sound hole of the peripheral housing. The second front acoustic cavity comprises a space between the second vibrating diaphragm and a part of the peripheral housing closing to the second vibrating diaphragm, and communicates with outside via the second sound hole of the peripheral housing; and the rear acoustic cavity comprises a space between the first vibrating diaphragm and the second vibrating diaphragm and is formed as a sealed hollow cavity.

Preferably, the supporting member may comprise a first supporting seat and a second supporting seat fixed on the inner surface of the peripheral housing, and a housing member fixed between the first supporting seat and the second supporting seat. The edges of the first vibrating diaphragm and the second vibrating diaphragm are fixed on a side wall of the housing member.

More preferably, the housing member may be integrally formed with the first supporting seat and the second supporting seat. Also, the housing member may be separately formed with the first supporting seat and the second supporting seat, and the housing member and the loudspeaker unit may constitute an individual loudspeaker. In the latter case, elastic buffering members may be provided between the housing member and the first supporting seat and between the housing member and the second supporting seat, respectively.

More preferably, the first supporting seat and the second supporting seat may be hollow, both ends of which are open, and an internal space of the housing member may be communicated with internal spaces of the first supporting seat and the second supporting seat via the through-holes of the housing member, respectively. A side wall of the first supporting seat may be formed with a through-hole communicated with the first sound hole, and/or a side wall of the second supporting seat may be formed with a through-hole communicated with the second sound hole. Also, an internal space of the first supporting seat may be communicated with outside via the first sound hole, and/or an internal space of the second supporting seat may be communicated with outside via the second sound hole. In the latter case, a dust screen may be provided at inner side or outer side of the first sound hole and/or the second sound hole.

More preferably, an acoustic vent hole may be formed on part of the housing member between the first vibrating diaphragm and the second vibrating diaphragm.

Additionally and preferably, the first sound hole and/or the second sound hole may comprise a plurality of circular or elongated through-holes.

Compared to the existing loudspeakers with vibrating function, the double-vibrating-diaphragm loudspeaker module of the present invention comprises a double-vibrating-diaphragm loudspeaker unit, wherein, the magnetic circuit system is supported by the second vibrating diaphragm instead of the elastic support, and the double-vibrating-diaphragm loudspeaker module comprises two front acoustic cavities and two sound holes communicated with the two front acoustic cavities respectively, so that the sound generated by the two vibration diaphragm can be fully utilized, and the low frequency acoustic characteristic of the whole loudspeaker module can be improved.

BRIEF DESCRIPTION OF THE FIGURES

The above features and technical advantages will be more clear and easy to be understood through the description referring to the accompanying drawings below.

DETAILED DESCRIPTION

The present invention will be described in details in connection with the accompanying drawings and embodiments.

Some exemplary embodiments of the present invention are described by illustration in the following description. Various modifications can be implemented by those skilled in the art without departing from the spirit and scope of the present invention. Consequently, the accompanying figures and description are illustrative, but not intended to limit the scope of the present invention. In the present description, the same reference numbers refer to the same or like parts.

The First Embodiment

Figure 1:
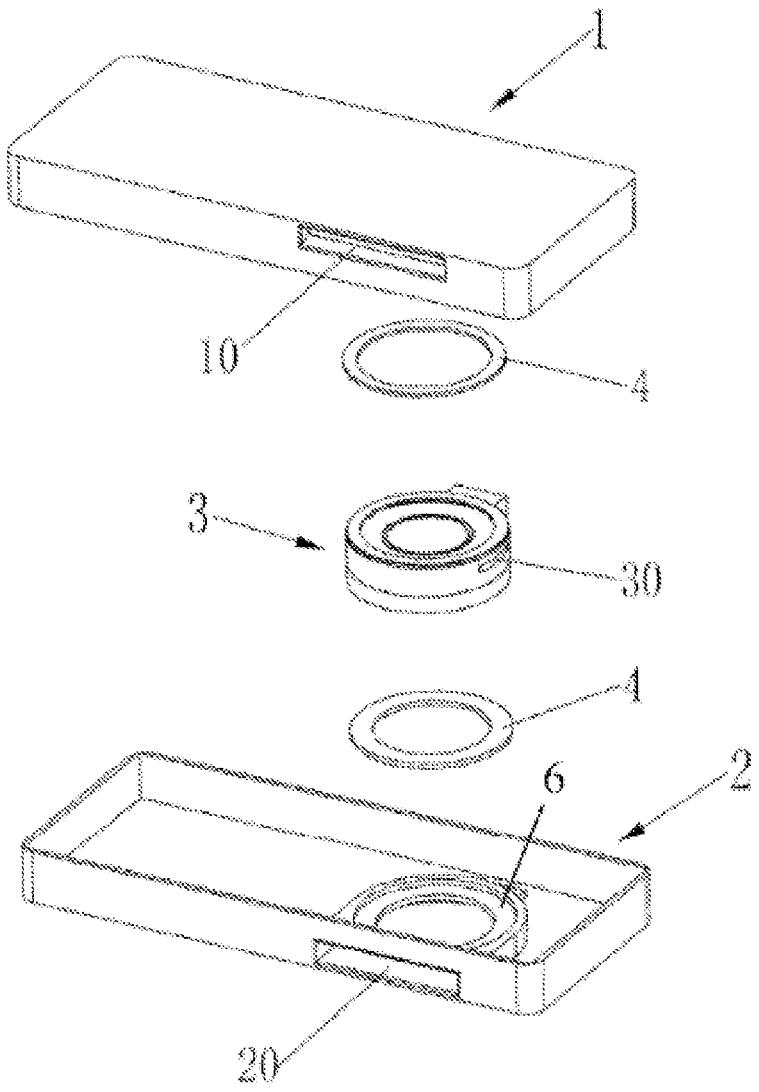
FIG. 1 is an exploded perspective view showing the structure of the double-vibrating-diaphragm loudspeaker module according to the first embodiment.
Figure 2:
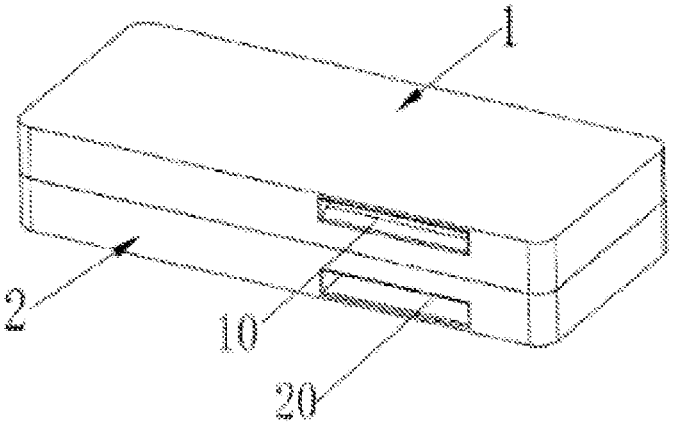
FIG. 2 is a perspective view showing the appearance of the double-vibrating-diaphragm loudspeaker module according to the first embodiment.
Figure 3:
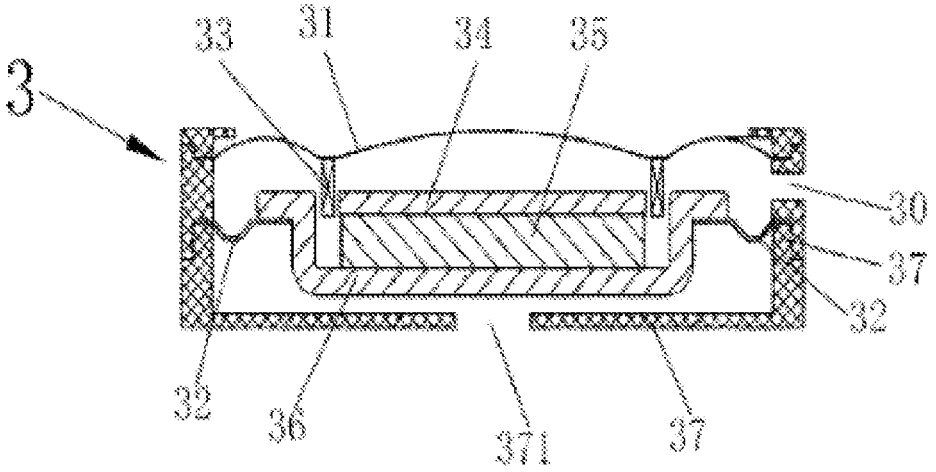
FIG. 3 is a cross sectional view showing the loudspeaker of the double-vibrating-diaphragm loudspeaker module according to the first embodiment.
Figure 4:
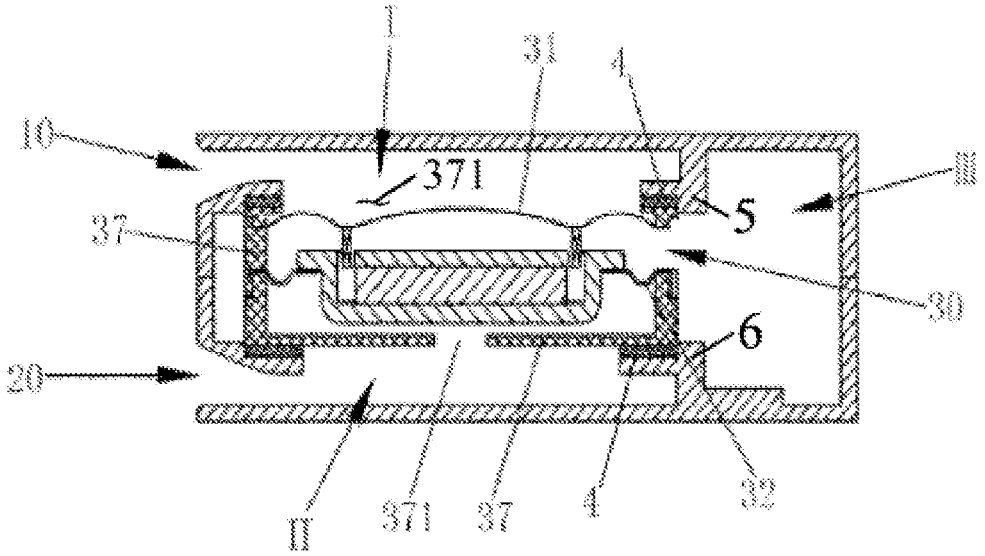
FIG. 4 is a cross sectional view along the first direction showing the sectional structure of the double-vibrating-diaphragm loudspeaker module according to the first embodiment.
Figure 5:
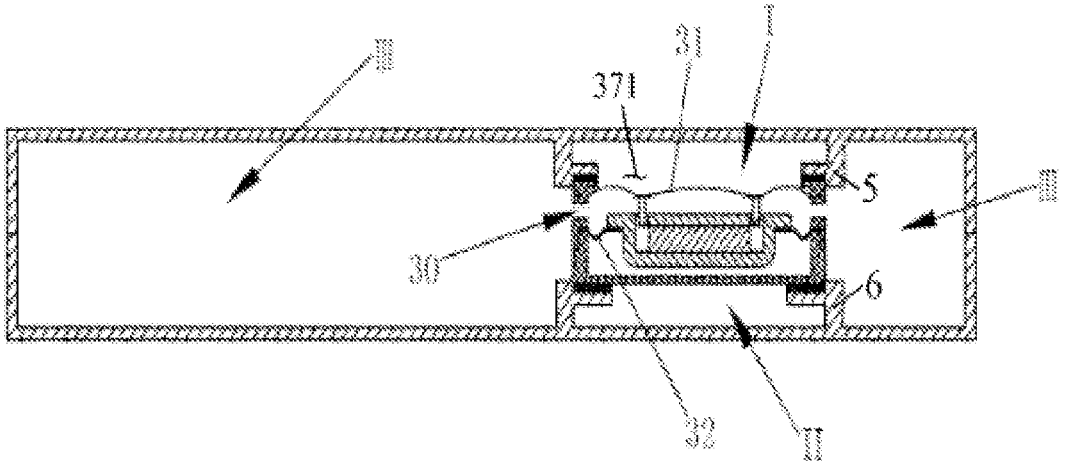
FIG. 5 is a cross sectional view along the second direction showing the sectional structure of the double-vibrating-diaphragm loudspeaker module according to the first embodiment.

FIG. 1 is an exploded perspective view showing the structure of the double-vibrating-diaphragm loudspeaker module according to the first embodiment; FIG. 2 is a perspective view showing the appearance of the double-vibrating-diaphragm loudspeaker module according to the first embodiment; FIG. 3 is a cross sectional view showing the loudspeaker of the double-vibrating-diaphragm loudspeaker module; FIG. 4 is a cross sectional view along the first direction showing the sectional structure of the double-vibrating-diaphragm loudspeaker module; FIG. 5 is a cross sectional view along the second direction showing the sectional structure of the double-vibrating-diaphragm loudspeaker module, wherein the first direction is perpendicular to the second direction.

As shown in FIG. 1 and FIG. 2, the double-vibrating-diaphragm loudspeaker module according to the first embodiment of the present invention comprises a first housing 1, a second housing 2, a double-vibrating-diaphragm loudspeaker 3, and a first supporting seat (not shown) and a second supporting seat 6. The first housing 1 is provided with a first sound hole 10, and the second housing 2 is provided with a second sound hole 20. The first supporting seat is fixed on the inner surface of the first housing 1, and the second supporting seat 6 is fixed on the inner surface of the second housing 2. The double-vibrating-diaphragm loudspeaker 3 is fixed between the first supporting seat and the second supporting seat 6. Preferably, elastic buffering members 4 may be provided between the double-vibrating-diaphragm loudspeaker 3 and the first supporting seat and between the double-vibrating-diaphragm loudspeaker 3 and the second supporting seat 6. The elastic buffering members 4 may be foams or spring washers for better sealing property between the double-vibrating-diaphragm loudspeaker 3 and the first and the second supporting seat. The first housing 1 and the second housing 2 can be combined by adhesive or ultrasonic welding, and the first housing 1 forms a peripheral housing in combination with the second housing 2.

Further, as shown in FIG. 3, the double-vibrating-diaphragm loudspeaker 3 comprises a housing member 37 and a loudspeaker unit, wherein, the loudspeaker unit comprises a first vibrating diaphragm 31, a second vibrating diaphragm 32, a voice coil 33 and a magnetic circuit system, and the magnetic circuit system may comprises a washer 34, a magnet 35 and a magnetic conductive frame 36. The voice coil 33 and the magnetic circuit system are combined with the first vibrating diaphragm 31 and the second vibrating diaphragm 32, respectively. The voice coil 33 is accommodated in a magnetic gap of the magnetic circuit system. The edges of the first vibrating diaphragm 31 and the second vibrating diaphragm 32 are fixed on a side wall of the housing member 37. The shape and material of the first vibrating diaphragm 31 may be identical to those of conventional vibration diaphragm, i.e., the first vibrating diaphragm 31 includes a dome part at the central area and a folding ring part at the edge area, but it does not limited to this. The second vibrating diaphragm 32 may have a hollow ring structure, the periphery of the magnetic conductive frame 36 is fixed to and combined with the inner edge of the ring structure of the second vibrating diaphragm 32, but it does not limited to this. The second vibrating diaphragm 32 may have stronger strength than that of the first vibrating diaphragm 31, preferably, the second vibrating diaphragm 32 may be made of materials, such as, PU or silicone rubber and the like.

The loudspeaker unit of the present invention has both the effects of vibration and sound production. Specifically, the first vibrating diaphragm 31 and the voice coil 33 constitute the vibration system of the loudspeaker unit. When intermediate or high-frequency signals is applied to the voice coil 33, the voice coil 33 vibrates up and down due to force generated in the magnetic field of the magnetic circuit system so as to drive the first vibrating diaphragm 31 to vibrate. Thus the vibration system vibrate to produce sound while intermediate or high-frequency signals is applied thereto. In this case, the magnetic circuit system with relatively lower resonant frequency does not vibrate essentially. When low-frequency signals is applied to the voice coil 33, the vibration system does not vibrate, essentially. In this case, the magnetic circuit system with relatively lower resonant frequency vibrates due to the force generated by the voice coil 33 and drives the second vibrating diaphragm 32 to vibrate, so that the loudspeaker unit can generate vibration and low frequency acoustics signals. Thus the low frequency acoustic characteristic of the double-vibrating-diaphragm loudspeaker module is improved.

As shown in FIGS. 4 and 5, the first supporting seat 5 and the second supporting seat 6 are hollow, both ends of which are open, and an internal space of the housing member 37 of the loudspeaker unit is communicated with internal spaces of the first supporting seat 5 and the second supporting seat 6 via the through-holes 371 of the housing member 37, respectively. A side wall of the first supporting seat 5 is formed with a through-hole communicated with the first sound hole 10 (this through-hole is integrally formed with the first sound hole 10, not shown), a side wall of the second supporting seat 6 is formed with a through-hole communicated with the second sound hole 20 (this through-hole is integrally formed with the second sound hole 20, not shown).

Additionally, an acoustic vent hole 30 is formed on part of the housing member between the first vibrating diaphragm 31 and the second vibrating diaphragm 32.

The peripheral housing, the first supporting seat 5, the second supporting seat 6, the housing member 37 and the loudspeaker unit define a first front acoustic cavity I, a second front acoustic cavity II and a back acoustic cavity III. The first front acoustic cavity I comprises a space between the first vibrating diaphragm 31 and a part of the peripheral housing close to the first vibrating diaphragm 31, and communicates with outside via the first sound hole 10 on the peripheral housing, thus the sound generated by the first vibrating diaphragm 31 can be transmitted to outside via the first sound hole 10. The second front acoustic cavity II comprises a space between the second vibrating diaphragm 32 and a part of the peripheral housing close to the second vibrating diaphragm 32, and communicates with outside via the second sound hole 20 on the peripheral housing, thus the sound generated by the second vibrating diaphragm 32 can be transmitted to outside via the second sound hole 20. The back acoustic cavity III comprises a space between the first vibrating diaphragm 31 and the second vibrating diaphragm 32, and an acoustic vent hole 30 enables the space between the first vibrating diaphragm 31 and the second vibrating diaphragm 32 to be communicated with the external space of the housing member 37. The back acoustic cavity III forms a sealed hollow cavity.

The construction of the double-vibrating-diaphragm loudspeaker module of the present invention is described in connection with the first embodiment. However, the present invention is not limited to this. For example, in the first embodiment, the housing member 37, the first supporting seat 5 and the second supporting seat 6 are separately formed, and the housing member 37 and the loudspeaker unit constitute an individual loudspeaker. In this case, elastic buffering members 4 are provided between the housing member 37 and the first supporting seat 5 and between the housing member 37 and the second supporting seat 6, respectively. In other embodiments, the housing member 37, the first supporting seat 5 and the second supporting seat 6 are integrally formed. Thus, the first supporting seat 5 and the second supporting seat 6 fixed on the inner surface of the peripheral housing, and the housing member 37 fixed between the first supporting seat 5 and the second supporting seat 6 can be considered as a more general supporting member, which is fixed on the inner surface of the peripheral housing. Meanwhile, the edges of the first vibrating diaphragm 31 and second vibrating diaphragm 32 are fixed on the supporting member, and the peripheral housing, the supporting member and the loudspeaker unit form a first front acoustic cavity I, a second front acoustic cavity II and a back acoustic cavity III.

The Second Embodiment

Figure 6:
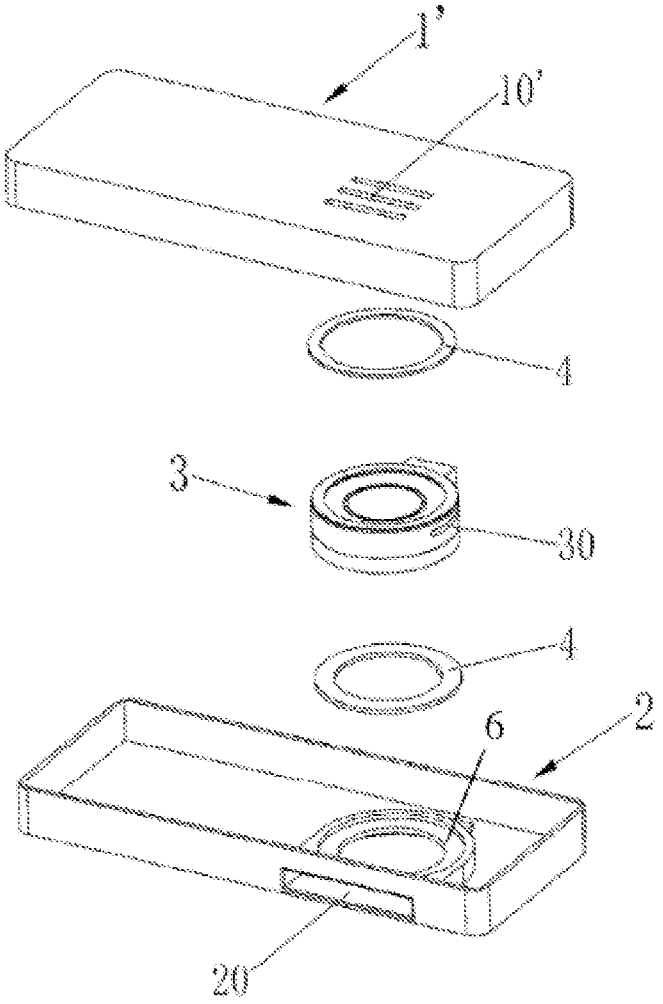
FIG. 6 is a exploded perspective view showing the structure of the double-vibrating-diaphragm loudspeaker module according to the second embodiment.
Figure 7:
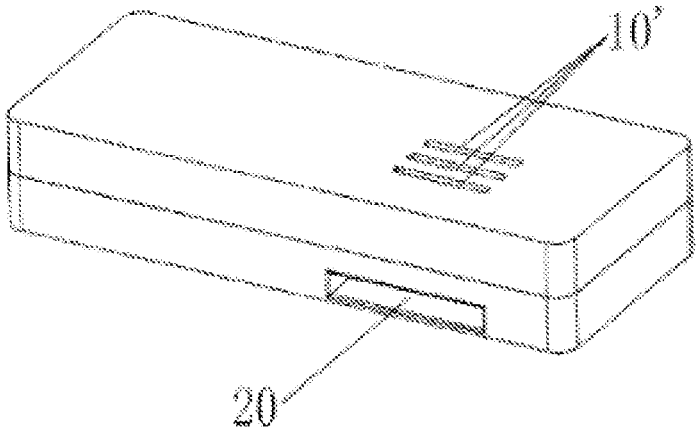
FIG. 7 is a perspective view showing the appearance of the double-vibrating-diaphragm loudspeaker module according to the second embodiment.

FIG. 6 is a exploded perspective view showing the structure of the double-vibrating-diaphragm loudspeaker module according to the second embodiment; FIG. 7 is a perspective view showing the profile of the double-vibrating-diaphragm loudspeaker module according to the second embodiment; and FIG. 8 is a cross sectional view along the first direction showing the sectional structure of the double-vibrating-diaphragm loudspeaker module according to the second embodiment.

Figure 8:
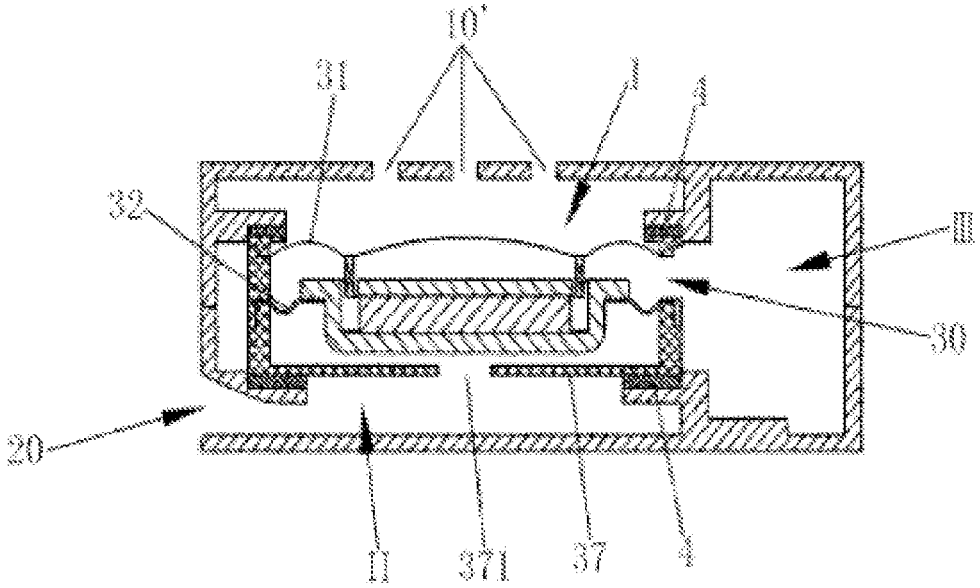
FIG. 8 is a cross sectional view along the first direction showing the sectional structure of the double-vibrating-diaphragm loudspeaker module according to the second embodiment.

As shown in FIG. 6 and FIG. 8, the double-vibrating-diaphragm loudspeaker module according to the second embodiment is different from that of the first embodiment in that: in the double-vibrating-diaphragm loudspeaker module according to the second embodiment, an internal space of the first supporting seat 5 is communicated with outside via the first sound hole 10'. That is to say, in the second embodiment, the sidewall of the first supporting seat 5 can be not provided with through-holes, the first sound hole 10' of the peripheral housing directly face to the open end of the first supporting seat 5, so as to directly face to the first vibrating diaphragm 31.

In this case, a dust screen can be provided inside or outside of the first sound hole 10' to avoid dust from entering into an internal space of the loudspeaker module from the first sound hole 10'. As an example, a metal screen or nonmetal screen (such as nylon screen cloth) for preventing dust can be disposed by injection molding, hot melting, etc.

In the second embodiment, the arrangement of the second sound hole 20 can be the same as that of the second sound hole 20 of the first embodiment, i.e., arranged on the sidewall of the peripheral housing, and communicates with the through-holes of the sidewall of the second supporting seat 6. However, in other embodiments, the arrangement of the second sound hole 20 can be similar to that of the first sound hole 10' of the second embodiment, i.e., arranged to be directly face to the second vibrating diaphragm 32. Alternatively, the arrangement of the first sound hole can be the same as that of the first sound hole of the first embodiment, i.e., arranged on the sidewall of the peripheral housing, and communicates with the through-holes of the sidewall of the first supporting seat 5, while the arrangement of the second sound hole can be similar to that of the first sound hole of the second embodiment, i.e., arranged to be directly face to the second vibrating diaphragm 32. Those configurations fall into the scope of the present invention.

The first sound hole and/or the second sound hole of the above embodiments can comprise a plurality of round-shaped or narrow strip-shaped through-holes. The design of the shape of the first sound hole and second sound hole has certain flexibility, depending on the peripheral housing, the internal supporting member thereof, the structure and space limitation of the loudspeaker unit, acoustics effect.

The structure of the peripheral frame in the above embodiments may have a rectangle structure, may also have other regular or irregular shapes, and may also be normal structures with arc-shaped edges and grooves in the loudspeaker module.

As we can known from the above description and practice, the double-vibrating-diaphragm loudspeaker module of the present invention comprises a double-vibrating-diaphragm loudspeaker unit, wherein, the magnetic circuit system is supported by the second vibrating diaphragm instead of an elastic support, and the double-vibrating-diaphragm loudspeaker module comprises two front acoustic cavities and two sound holes communicated with the two front acoustic cavities, respectively. Therefore, the sound generated by the two vibration diaphragm can be fully utilized, and the low frequency acoustic characteristic of the whole loudspeaker module can be improved.

It should be noted that various improvements, variants and combinations thereof can be made by those skilled in the art based on the above embodiments which fall into the scope of the present invention. It will be understood that the above specific description is only used for illustrate the present invention, the scope of the present invention is limited by the claims and its equivalents.

The invention claimed is:

1. A double-vibrating-diaphragm loudspeaker module comprising:

a peripheral housing provided with a first sound hole and a second sound hole;

a supporting member fixed on an inner surface of the peripheral housing; and a loudspeaker unit comprising a first vibrating diaphragm, a voice coil, a magnetic circuit system and a second vibrating diaphragm, wherein, the voice coil is coupled with the first vibrating diaphragm, the magnetic circuit system is coupled with the second vibrating diaphragm, the voice coil is accommodated in a magnetic gap of the magnetic circuit system, and edges of the first vibrating diaphragm and the second vibrating diaphragm are fixed on the supporting member, wherein, the peripheral housing, the supporting member and the loudspeaker unit define a first front acoustic cavity, a second front acoustic cavity, and a rear acoustic cavity;

the first front acoustic cavity comprises a space between the first vibrating diaphragm and a part of the peripheral housing close to the first vibrating diaphragm, and communicates with outside via the first sound hole of the peripheral housing;

the second front acoustic cavity comprises a space between the second vibrating diaphragm and a part of the peripheral housing close to the second vibrating diaphragm, and communicates with outside via the second sound hole of the peripheral housing; and the rear acoustic cavity comprises a space between the first vibrating diaphragm and the second vibrating diaphragm and is formed as a sealed hollow cavity.

2. The double-vibrating-diaphragm loudspeaker module according to claim 1, wherein, the supporting member comprises a first supporting seat and a second supporting seat fixed on the inner surface of the peripheral housing, and a housing member fixed between the first supporting seat and the second supporting seat, and the edges of the first vibrating diaphragm and the second vibrating diaphragm are fixed on a side wall of the housing member.

3. The double-vibrating-diaphragm loudspeaker module according to claim 2, wherein, the housing member is integrally formed with the first supporting seat and the second supporting seat.

4. The double-vibrating-diaphragm loudspeaker module according to claim 2, wherein, the housing member is separately formed with the first supporting seat and the second supporting seat, and the housing member and the loudspeaker unit constitute an individual loudspeaker.

5. The double-vibrating-diaphragm loudspeaker module according to claim 4, wherein, elastic buffering members are provided between the housing member and the first supporting seat and between the housing member and the second supporting seat, respectively.

6. The double-vibrating-diaphragm loudspeaker module according to claim 2, wherein, the first supporting seat and the second supporting seat are hollow, both ends of which are open, and an internal space of the housing member is communicated with internal spaces of the first supporting seat and the second supporting seat via through-holes of the housing member respectively; and wherein, a side wall of the first supporting seat is formed with a through-hole communicated with the first sound hole, and/or a side wall of the second supporting seat is formed with a through-hole communicated with the second sound hole.

7. The double-vibrating-diaphragm loudspeaker module according to claim 2, wherein, the first supporting seat and the second supporting seat are hollow, both ends of which are open, and an internal space of the housing member is communicated with internal spaces of the first supporting seat and the second supporting seat via through-holes of the housing member respectively; and wherein, the internal space of the first supporting seat is communicated with outside via the first sound hole, and/or the internal space of the second supporting seat is communicated with outside via the second sound hole.

8. The double-vibrating-diaphragm loudspeaker module according to claim 7, wherein, a dust screen is provided inside or outside of the first sound hole and/or the second sound hole.

9. The double-vibrating-diaphragm loudspeaker module according to claim 2, wherein, an acoustic vent hole is formed on a part of the housing member between the first vibrating diaphragm and the second vibrating diaphragm.

10. The double-vibrating-diaphragm loudspeaker module according to claim 1, wherein, the first sound hole and/or the second sound hole comprises one or more circular or elongated through-holes.

11. The double-vibrating-diaphragm loudspeaker module according to claim 1, wherein the supporting member comprises a housing member with a vent hole between the space between the first vibrating diaphragm and the second vibrating diaphragm and a separate chamber of the sealed hollow cavity that is enclosed by the peripheral housing.

* * * * *